United States Patent [19]

Reist et al.

[11] 4,320,894

[45] Mar. 23, 1982

[54] APPARATUS FOR OUTFEEDING FLAT PRODUCTS, ESPECIALLY PRINTED PRODUCTS, ARRIVING IN AN IMBRICATED ARRAY

[75] Inventors: Walter Reist, Hinwil; Werner Honegger, Tann-Rüti, both of Switzerland

[73] Assignee: Ferag AG, Hinwil, Switzerland

[21] Appl. No.: 51,344

[22] Filed: Jun. 25, 1979

[30] Foreign Application Priority Data

Jun. 30, 1978 [CH] Switzerland ..... 7134/78

[51] Int. Cl.[3] ..... B65H 5/12; B65H 29/04; B65G 47/86

[52] U.S. Cl. ..... 271/277; 271/204; 271/186; 271/69; 271/225; 198/650

[58] Field of Search ..... 271/225, 69, 212, 3.7, 271/204, 184, 186, 187, 277, 205, 206, 315, 178; 198/429, 650, 653, 695, 696

[56] References Cited

U.S. PATENT DOCUMENTS

| | | | |
|---|---|---|---|
| 3,345,065 | 10/1967 | Shearer | 271/206 |
| 4,010,945 | 3/1977 | Kistner | 271/151 |
| 4,015,843 | 4/1977 | Tennant | 271/240 |
| 4,034,845 | 7/1977 | Honegger | 271/204 |
| 4,058,202 | 11/1977 | Reist et al. | 271/277 |
| 4,201,286 | 5/1980 | Meier | 271/277 |

FOREIGN PATENT DOCUMENTS

| | | | |
|---|---|---|---|
| 821418 | 8/1969 | Canada | 271/310 |
| 1051868 | 3/1959 | Fed. Rep. of Germany | 271/212 |

*Primary Examiner*—Robert B. Reeves
*Assistant Examiner*—Brian Bond
*Attorney, Agent, or Firm*—Werner W. Kleeman

[57] ABSTRACT

An apparatus for outfeeding printed products arriving in an imbricated product stream, in which, in each case, the leading edge of a printed product overlies the rearward edge of the preceding printed product. The arriving imbricated product stream is infed, by means of a conveyor belt or band, to the conveying gap of a deflection or turning device where the imbricated product stream is turned through about 180°. This deflection device comprises a deflection drum about which there is guided an endless conveyor belt. A pressing or contact belt, held under tension, is arranged opposite the deflection drum and forms together therewith the conveying gap. The pressing belt presses the printed products, traveling through the conveying gap, against the deflection drum. The conveyor belt guided about the deflection drum conveys the printed products, departing out of the conveying gap, towards an individual conveyor. This individual conveyor possesses individually actuatable grippers which, viewed in the product conveying direction, are arranged behind one another and attached to a traction element. These grippers engage the printed products, infed by the conveyor belt, at their leading edges and convey such upwardly away. At the transfer region the conveying direction of the individual conveyor extends from below towards the top and transversely with respect to the surface of the printed products, so that the latter are raised upwardly and detached from the imbricated product stream.

32 Claims, 6 Drawing Figures

Fig. 3
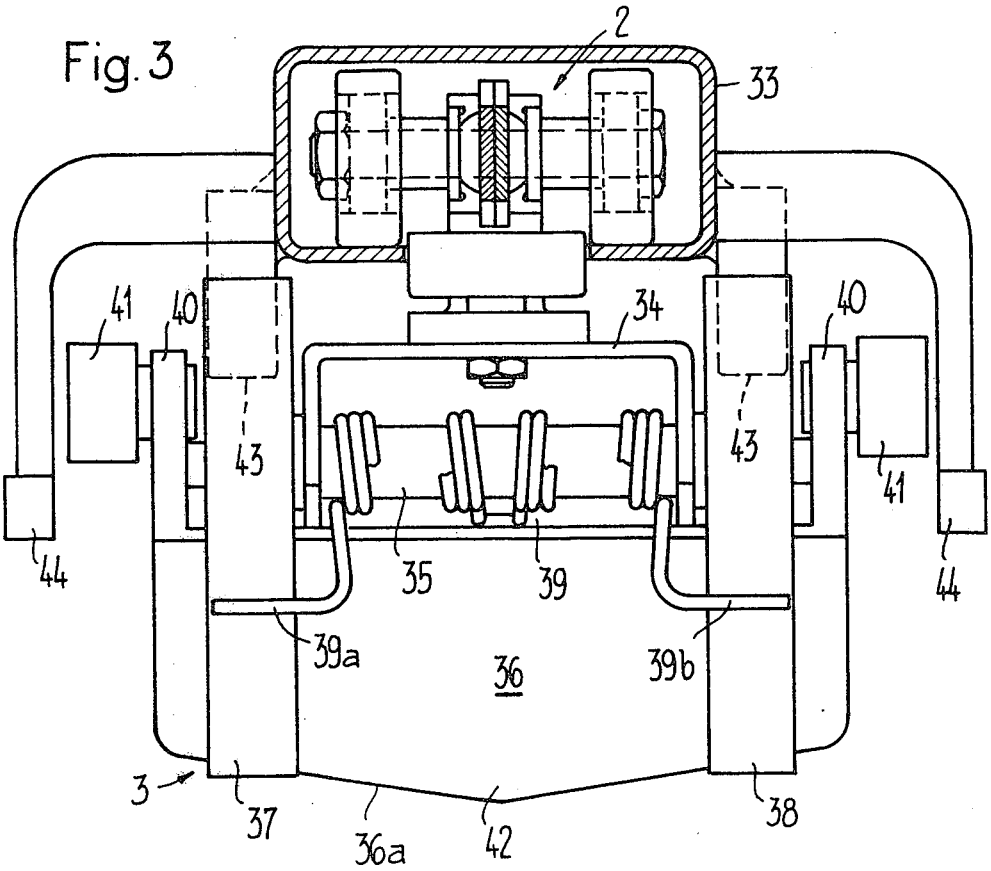
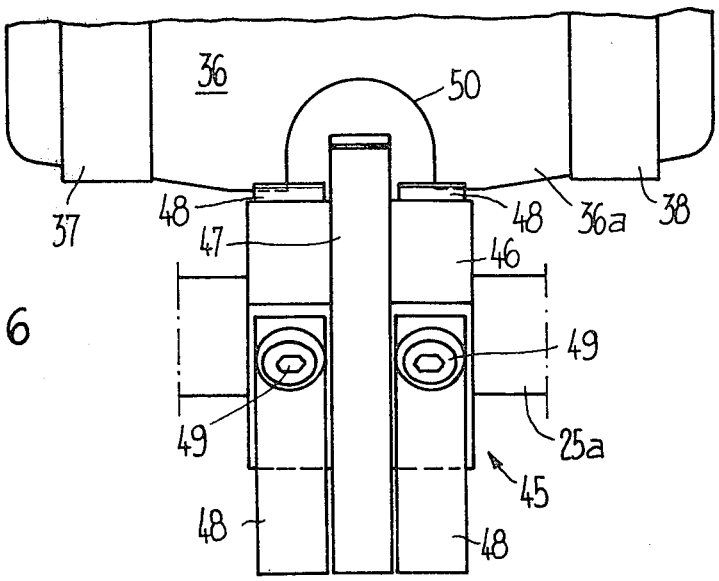
Fig. 6

APPARATUS FOR OUTFEEDING FLAT PRODUCTS, ESPECIALLY PRINTED PRODUCTS, ARRIVING IN AN IMBRICATED ARRAY

BACKGROUND OF THE INVENTION

The present invention relates to a new and improved construction of apparatus for outfeeding flat products, especially printed products, arriving in an imbricated product stream or array. The apparatus of the invention is of the type comprising a conveyor device, which in the conveying direction of the prodcuts, possesses tandemly arranged, individually controllable grippers for engaging or seizing the infed products at their leading edges.

In most instances, the imbricated product stream arrives in a formation where each product bears upon the preceding product, so that the rear edge of the product is covered by the trailing or subsequent product. Up to the present attempts were made to outfeed the imbricated product stream, by the conveyor device, also in the formation or array in which it arrived. With heretofore known equipment of such type, as exemplified by German Patent Publication No. 2,519,561 and the corresponding U.S. Pat. No. 3,955,667, the imbricated product stream is delivered, by means of a belt conveyor, to a transport device whose conveying direction essentially is the same as that of the belt conveyor. Since the edges of the printed products, which are to be engaged, are not freely exposed at the transfer region, the grippers must be inserted into the imbricated product stream, in order to seize the printed products. Additionally, an appreciable structural length is required in the conveying direction, since at the transfer region the transport device and the belt conveyor must be guided adjacent one another throughout a certain path or distance, in order to insure for a correct transfer of the printed products.

SUMMARY OF THE INVENTION

Therefore, with the foregoing in mind it is a primary object of the present invention to provide a new and improved construction of apparatus for outfeeding flat products, especially printed products, arriving in an imbricated array or formation, in a manner not associated with the aforementioned drawbacks and limitations of the prior art proposals.

Another and more specific object of the present invention aims at the provision of an apparatus of the previously mentioned type, which, while avoiding the aforementioned drawbacks, enables seizing the leading edges of the products by the grippers of the conveyor device in a simple and reliable manner.

Still a further significant object of the present invention relates to a new and improved construction of apparatus for outfeeding flat products, especially printed products, arriving in an imbricated product stream, which apparatus is relatively simple in construction and design, economical to manufacture, does not require any excessive structural length, is extremely reliable in operation, not readily subject to breakdown or malfunction, and requires a minimum of maintenance and servicing.

Now in order to implement these and still further objects of the invention, which will become more readily apparent as the description proceeds, the apparatus of the present development is manifested by the features that there is provided a device for the infeed of the products to the conveyor device in an imbricated formation or array, where each product bears upon the next following or successive product.

Since at the imbricated product stream, infed to the conveyor device, each product bears upon the next following product, the product which is to be engaged in each case by a gripper is freely exposed. Therefore, the product can be faultlessly seized at its leading edge by the gripper and can be raised from the next following product. The freely exposed front edge of the product allows for a contactless recognition or detection of the products, for instance counting of the products.

The conveying direction of the conveyor device at the transfer region advantageously extends transversely with respect to the plane of the products to be seized and is preferably directed from below towards the top. Consequently, the products travel into the opened gripper, and thus, also can be properly seized when the products do not arrive exactly in-phase with the grippers at the transfer region. If the imbricated product stream arrives in a formation where each individual product bears upon the preceding or immediately leading product, then there is arranged ahead of the conveyor device a deflection or turning device for turning the imbricated product stream. This deflection device can initiate a turning of the arriving imbricated product stream about its lengthwise axis, parallel to the conveying direction, through 180°, or can possess a deflection device, through which passes the imbricated product stream, for turning such product stream, and having at its outfeed side a conveyor device which works in the opposite sense to the conveying direction of the imbricated product stream arriving at the deflection device. With an imbricated product stream arriving essentially in horizontal direction, it is possible, by virtue of such deflection or turning, to maintain the structural length small, since the imbricated product stream is upwardly deflected or turned, and preferably, also outfed upwardly, allowing for utilization of the available structural height.

There is already known to the art, from German Pat. No. 1,436,485, the technique of deflecting an imbricated product stream, formed by printed products which, in each case, bear upon the preceding product, through about 180°. Yet, this deflection or turning action exclusively serves the purpose of introducing the printed products, following their deflection, from below into a stack. Nonetheless, as far as applicants are aware it has never heretofore been attempted, by virtue of such deflection or turning of the printed products, to freely expose the products for the purpose of seizing the products by the grippers of the conveyor and to remove the printed products out of the imbricated product stream by the conveyor. In consideration of the teachings of Swiss Pat. No. 530,926 and the corresponding U.S. Pat. No. 3,735,977, such is not surprising, since these patents, in contrast to the proposals of the invention, teach that an imbricated product stream, where each product bears upon the next following product, should again be turned prior to further processing, in order to finally again obtain a normal imbricated product stream where each product is partially covered.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 is a sectional view of the arrangement of FIG. 2, taken substantially along the line III—III thereof;

FIG. 6 is a top plan view of the arrangement of FIG. 4, looking essentially in the direction of the arrow H.

DETAILED DESCRIPTION OF THE PREFERRED EMBODIMENTS

Figure 1:
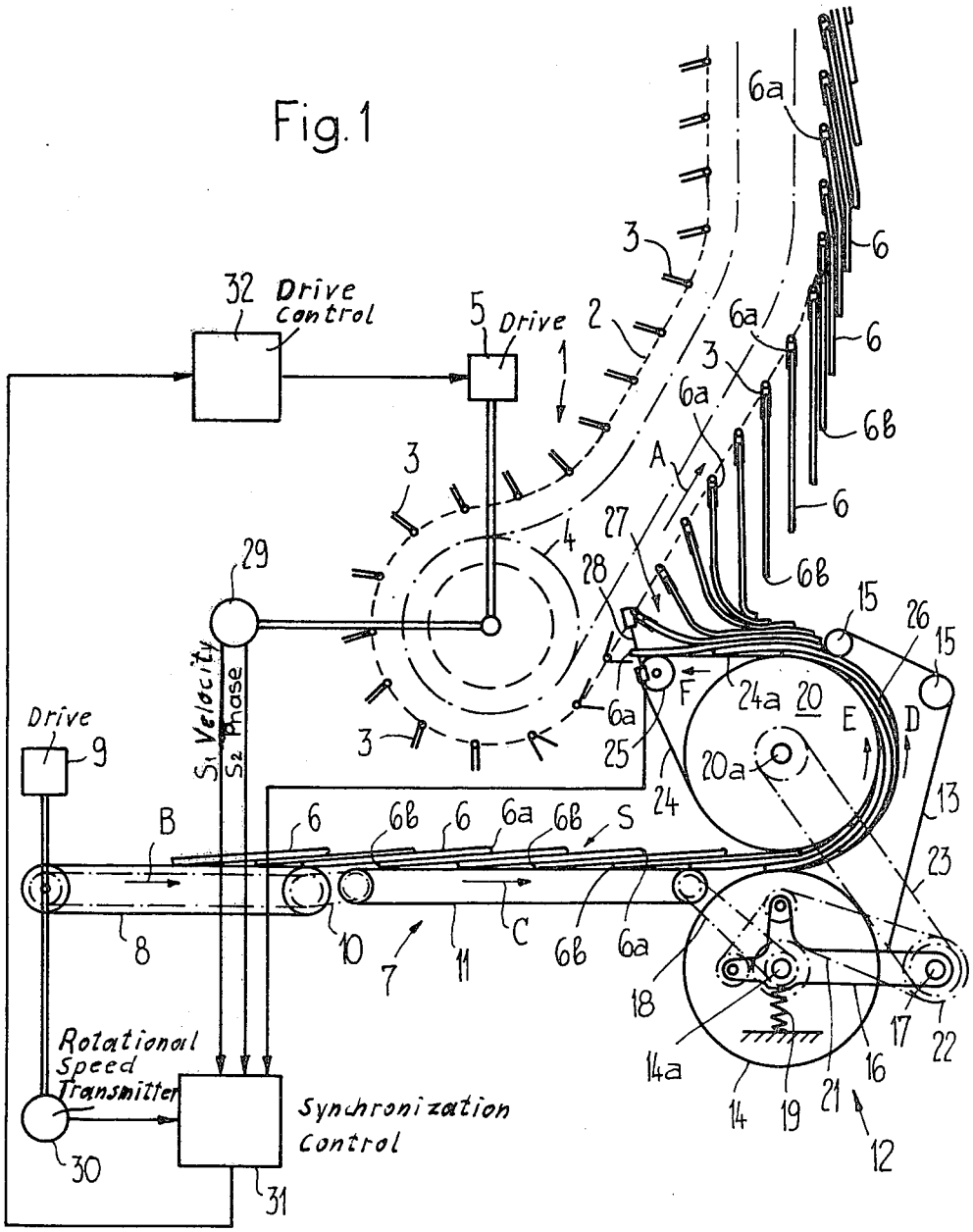
FIG. 1 is a side view of an exemplary embodiment of apparatus for the outfeed of printed products arriving in an imbricated array or product stream.

Describing now the drawings, the exemplary embodiment of feed apparatus illustrated in FIG. 1, will be seen to comprise an individual conveyor 1 equipped with a revolvingly driven traction element or traction means 2 at which there are attached in tandem arrangement, viewed with respect to the conveying direction A, individually controllable grippers 3. As to the exact construction of the traction element 2 and the grippers or gripper means 3, details thereof will be explained more fully hereinafter in conjunction with FIGS. 2 and 3. The traction element 2 is guided at its end, shown in the illustration of FIG. 1, about a deflection wheel 4 driven by any suitable drive motor 5. The individual grippers or gripper means 3 serve to engage the printed products 6, arriving in an imbricated product stream S and infed by means of an infeed or feed device 7, at their leading edges 6*a*, which, in the embodiment under consideration, is constituted by the fold edge, i.e., the so-called spine.

The imbricated product stream S which is delivered from any suitable supply source, for instance a rotary printing press, and wherein at the imbricated product stream S each printed product 6 bears against its immediately preceding product, is delivered to the infeed device 7. The latter comprises a first conveyor belt or band 8 or equivalent structure, revolvingly driven essentially in the horizontal conveying or feed direction B, by means of a suitable drive or drive means 9. The drive of the conveyor belt 8 advantageously is accomplished from the site of the supply source, i.e., in this case assumed to be the rotary printing press. Arranged after this first conveyor belt 8 is a second belt or band 11, driven by means of a drive element 10, such as a chain or belt, from the conveyor belt 8, and equally having a conveying or feed direction C essentially extending in horizontal direction. The conveyor belt 11 is arranged at the infeed side of a deflection or turning device 12 and delivers the imbricated product stream S to such deflection device 12. As far as such deflection or turning device 12 is concerned, in the embodiment under discussion the same comprises an endless, pressing or contact band or belt 13 revolvingly driven in the direction of the arrow D. This pressing or contact band or belt 13 is trained about a drive roll 14 rotatable about its shaft or axis 14*a* and is also guided about the deflection rolls 15. The drive roll 14 is mounted, together with its rotatable shaft 14*a*, at one end of a pivotal lever 16, which is pivotably mounted at the other end about a stationary pivot shaft 17. The drive of the drive roll or roller 14 is accomplished, from the location of the conveyor belt 11, by means of any suitable drive element 18, typically for instance a chain or belts or the like. The end of the pivotal or pivotable lever 16 which carries the drive roll 14 is supported upon a pressure or compression spring 19, causing a tensioning of the pressing or contact belt or band 13. Apart from the foregoing structure, the deflection device 12 embodies a deflection drum 20 which is rotatably driven about its shaft or axis 20*a* in the direction of the arrow E. Driving of the deflection drum 20 is accomplished from the drive roll 14, and specifically, by means of a drive belt or a drive chain 21, by toothed or belt pulley disks 22 driven by such drive belt or drive chain 21, and a further drive element 23, which likewise may be constituted by a chain or belts. Trained about the deflection drum 20 and equally about a deflection roll 25 is an endless conveyor belt or band 24 which revolves in the direction of the arrow F. Between the deflection drum or roll 20 and the conveyor belt 24 guided thereover and the drive belt or band 13, there is formed a conveying or feed gap 26 through which there is fed the imbricated product stream S to a transfer region 27. The portion or section 24*a* of the conveyor belt 24, arranged at the outfeed side of the deflection device 12 and moving in the conveying or feed direction F, extends essentially horizontally, forming with the conveying direction A of the individual conveyor or feed means 1, at the transfer region 27, an angle amounting to about 60°.

Continuing, now for the detection or recognition, for instance for counting the individual printed products 6, there is arranged at the transfer region 27 a standard light barrier means 28 which responds to each product 6 which is delivered by the conveyor belt or band 24 towards a gripper 3. The signals produced by such light barrier means 28 are infed to a synchronization control 31, constituting part of the drive control for the drive motor 5 of the individual conveyor 1. Operatively coupled with the deflection wheel 4 or equivalent structure is a rotational speed transmitter 29, which, at its output side, is coupled with the synchronization control 31 and produces output signals which are proportional to the conveying speed of the individual conveyor 1 and which are additionally characteristic of the position of the individual grippers 3. Additionally, the synchronization control 31 is connected with the output of a further rotational speed transmitter 30 which is coupled with the conveyor belt 8 and generates output signals proportional to the conveying speed of such conveyor belt or band 8. The output of the synchronization control 31 is connected with a drive control 32 which controls the drive motor 5. The schematically illustrated control for the drive motor 5 serves to regulate the conveying speed of the individual conveyor 1, i.e., to increase or reduce the same, as the case may be, such that each gripper 3 arrives at the transfer region 27 in synchronism with the printed product 6 which is to be seized by such gripper, so that each gripper 3 can engage the desired number of printed products 6. With the exemplary embodiment under discussion, each gripper 3 is assigned the task of seizing one of the printed products 6.

Based upon the illustration of FIG. 2, portraying the transfer region 27 of FIG. 1 on an enlarged scale, and also based upon the showing of FIG. 3, constituting a sectional view along the section line III—III of FIG. 2, there now will be explained more fully the construction of the individual conveyor 1 and its grippers or gripper means 3. The traction element 2 travels in a downwardly open, substantially C-shaped channel 33 and is constructed as a ball-and-socket link chain, as the same has been more fully described in German Patent Publication No. 2,629,528, to which reference may be readily had and the disclosure of which is incorporated herein by reference. Fixedly secured, as by threaded bolts or screws, at such ball-and-socket link chain 2 are bracket-shaped holders 34, in each of which there is mounted a respective shaft 35. Rotatably mounted upon each of these shafts 35 is a lower, essentially plate-shaped clamping jaw 36 and two upper, substantially bracket-shaped clamping jaw 37 and 38 arranged in a spaced relationship from one another. Furthermore, seated upon each shaft 35 is a torsion spring 39 bearing with its legs 39*a* and 39*b* upon the upper clamping jaws or jaw means 37 and 38 and pressing such upper clamping jaws 37, 38 against the lower clamping jaw 36. The clamping jaws 36 and 37, 38 are thus held, by such related torsion spring 39, in their product clamping position. The clamping jaws 36, 37 and 38 are conjointly rotatable about the related shaft 35, whereas both of the upper clamping jaws 37 and 38 are additionally and independently of one another pivotable about such shaft 35 into their open position. This will be explained more fully hereinafter. The lower clamping jaw 36 possesses to each side a lever 40 having a control roll 41 or equivalent structure. Such lever 40 and the control rolls 41 serve, in conventional and therefore not particularly illustrated manner, to again release the printed products 6, seized by the grippers 3, at a delivery or outfeed location. As particularly evident from the showing of FIG. 2, the front edge 36*a* of the lower clamping jaw is bent of flexed and has a wedge-shaped construction and is equipped with a guide or directing surface 42 serving to introduce the printed products 6 which run onto such surface 42, into the opened gripper 3.

Figure 2:
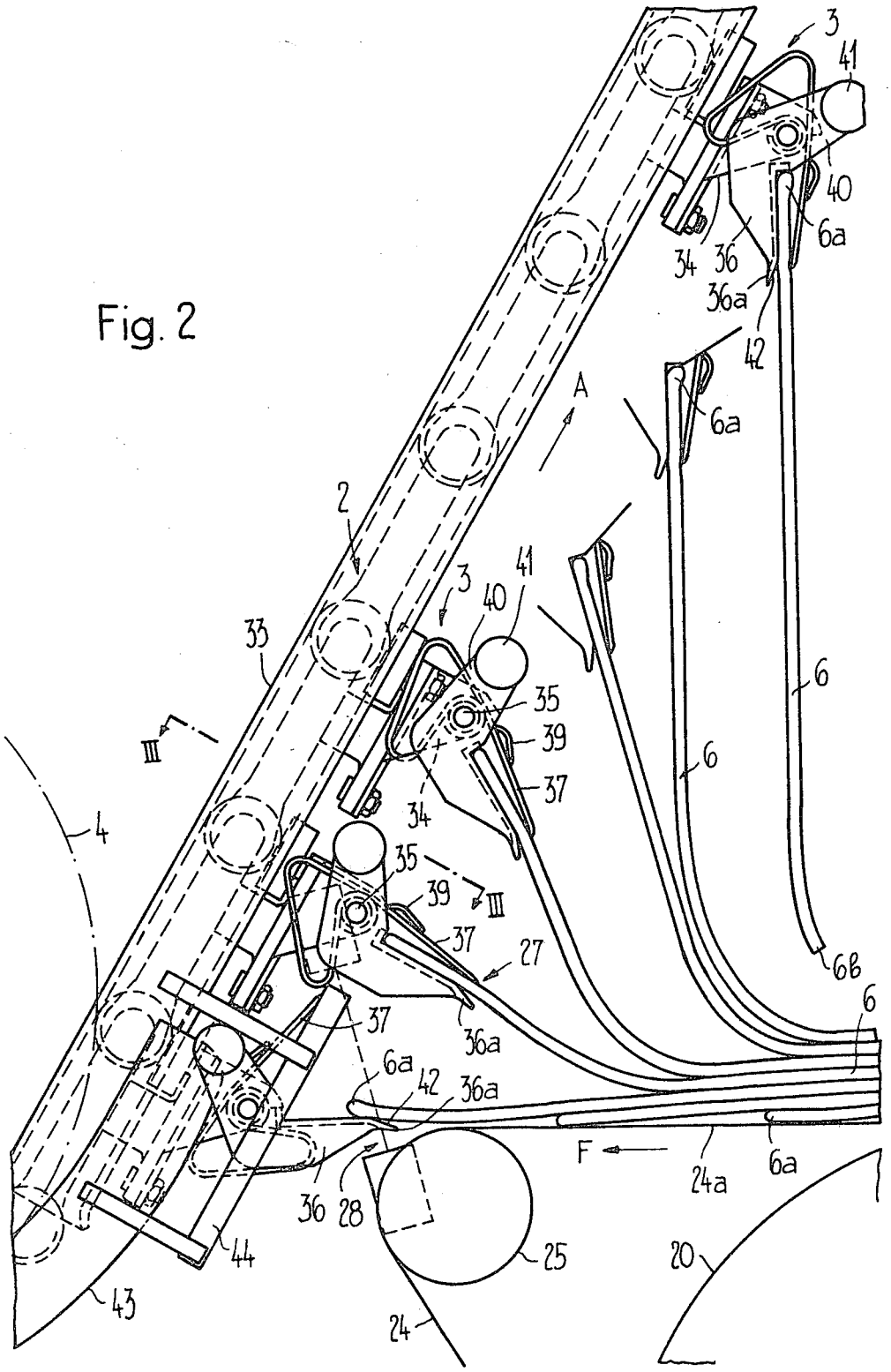
FIG. 2 is a sectional view of the apparatus shown in FIG. 1, on an enlarged scale.

Now with reference to FIGS. 2 and 3 there will be considered both of the cams or control surfaces 43 or equivalent structure arranged laterally of the channel 3. These cams 43, viewed in the conveying direction A of the individual conveyor 1, are arranged forwardly of the actual transfer region 27. The upper clamping jaws 37 and 38 ride upon such cams 43, initially causing a rocking of the closed gripper 3 about the shaft 35, as the same has been schematically shown in FIG. 1. Thereafter, the upper clamping jaws 37 and 38 are rocked by such cams 43, against the force of the torsion spring 39, into their opened position, as the same has been illustrated in FIG. 2. In this way there is achieved the beneficial result that each gripper 3 arrives at the transfer region 27 in the correct position and with opened clamping jaws 37 and 38.

Laterally of the path of travel of the grippers 3 there are arranged at the transfer region 27 two stop or impact rails 44, which, in a manner to be explained more completely hereinafter, serve as stop or impact means for the individual printed products. 6.

Having now had the benefit of the foregoing discussion of the exemplary embodiment of outfeed apparatus for flat products, its mode of operation will be described and is as follows:

The imbricated product stream S, arriving from the product supply source, for instance assumed to be a rotary printing press, and wherein the printed products 6 repose over one another in the fashion of tiles of a roof, such that the leading edge 6*a* of each printed product 6 covers the trailing edge 6*b* (the cut portion or flower) of the preceding printed product, is conveyed by means of the conveyor belts 8 and 11, essentially in horizontal direction, i.e., in the conveying direction B, C to the deflection or turning device 12. Along this conveying path the printed products 6, at the region of the conveyor belt or band 11, are aligned within the imbricated stream S by any suitable, conventional and therefore not further shown, alignment device. From the conveyor belt or band 11 the printed products 6 arrive at the conveying or feed gap 26 and are moved, by means of the conveyor belt or band 24 and the pressing band 13, through such conveying gap 26. In the conveying gap 26 the printed products 6 are urged, and thus pressed, by the action of the tensioned pressing or contact band 13, against the deflection drum or roll 20. In the deflection device 12 there is accomplished a deflection or turning of the arriving imbricated product stream S through an angle of about 180°.

Now the printed products 6 which are moving out of the conveying gap 26, are conveyed by means of the horizontal portion or section 24*a* of the conveyor belt 24 to the transfer region 27 and towards the individual conveyor or feed means 1. After this deflection the individual printed products 6 in the imbricated product stream 7 bear upon the next following product, i.e., the rearward edge 6*b* of each printed product 6 now bears above the next following printed product 6 and no longer below such next following printed product 6, as such is the case for the arriving imbricated product stream S prior to the turning operation. However, it is to be appreciated that the edge 6*a* of each printed product, which edge was leading prior to the turning or deflection operation, even after the turning operation still constitutes the leading edge. As already explained, the synchronization control insures that a gripper 3 arrives at the transfer region 27 at the same time as does a printed product 6. By means of the cams or cam means 43 or equivalent structure, the grippers 3 are rotated, in the described manner, into their correct position and at the same time opened, so that the arriving printed product 6 with the leading edge 6*a* leading, can now travel into the opened gripper 3, as such has been particularly well illustrated in FIG. 2. The guide or directing surface 42 at the front edge 36*a* of the lower clamping jaw 36 now insures that, the printed products 6, without being damaged, can travel into the opened gripper 3. Since during the further movement of the gripper 3 in the conveying direction A, the upper clamping jaws 37 and 38 can lift-off the cams or cam means 43, these upper clamping jaws 37, 38 can be brought, by the action of the related torsion spring 39 or equivalent structure, into their clamping position where they press the printed product 6 against the lower clamping jaw 36, with the result that the printed product 6 is fixedly held in place. The thus engaged printed product 6 is now removed from the imbricated product stream S, i.e., separated therefrom, due to the action of the moving gripper 3 which is displaced upwardly at an inclination. Since the grippers or gripper means 3 are mounted to be freely rotatable upon the shafts 35, the printed products 6 are outfed while freely downwardly hanging, as this has been shown in FIGS. 1 and 2. The outfeed or conveying away of the printed products 6 by the individual conveyor 1 can again be accomplished in an imbricated formation. The not particularly illustrated delivery of the printed products 6 can be accomplished in different ways. Thus, for instance, the printed products 6 again can be delivered as an imbricated product stream, having the same or even a different formation of the printed products than the arriving imbricated product stream S.

In the event that a printed product 6 should arrive, in front of the gripper 3, at the transfer region or station 27, then the printed product 6 travels against the impact or stop rails 44 and is prevented by the latter from carrying out any further movement until it is entrained by the next gripper 3. As best seen by referring to FIG. 2, the upper clamping jaws 37 and 38 are opened to such an extent that they travel past a printed product 6 impacting against the impact or stop rails 44, and such printed product can be engaged therebeneath by the lower clamping jaw 36. If a printed product 6 is located somewhat rearwardly, in relation to its gripper 3, then the conveyor belt 24, forming with the conveying direction A of the individual conveyor 1 an acute angle, nonetheless allows for the travel of the printed product 6 into the opened gripper 3.

Since the leading edge 6*a* of the relevant printed product 6 which is to be engaged is freely exposed, there can be beneficially employed for the product detection or recognition, such as counting of the printed products, contactless systems, for instance, as shown, a light barrier means 28. In contrast to the mechanical detection, required with other solutions, it is possible, in this manner, to avoid any damage to the printed products 6.

With the illustrated exemplary embodiment, the conveying speed of the individual conveyor 1 is coordinated to the conveying capacity of the infeed device 7 in a manner such, that each gripper 3 only seizes and outfeeds one printed product 6. By appropriately reducing the conveying speed of the individual conveyor 1 in relation to the conveying speed of the conveyor belt or band 24 and by reducing the imbricated spacing of the arriving imbricated product stream S, it is however also possible to engage and outfeed, by means of a single gripper 3, two or more printed products 6. This means that the corresponding number of printed products 6 travels into an open gripper 3, before such is again closed. A reduction of the conveying speed of the individual conveyor 1 affords a quieter travel, lesser wear, and thus, longer service life of the equipment.

To the extent that it is not necessary for the further processing of the products that, for each gripper 3, there is always available the same, predetermined number of printed products 6, the drive of the individual conveyor 1 can be independent of the drive of the infeed device 7. In this case there can be dispensed with the use of the light barrier means 28 and the synchronization control 31. The drive motor 5 of the individual conveyor 1 can be, by way of example, as asynchronous motor operating at constant speed. As described, the infeed device 7 is preferably driven by the product supply source which delivers the imbricated product stream S. Since the drives of the individual conveyor 1 and the infeed device 7 are separate from one another, there is not madatorily engaged by each gripper 3 the same number of printed products 6. Thus, it can happen that, for instance, upon start-up of the equipment there are not available a sufficient number of printed products 6, so that not every gripper 3 can seize a product copy. At a later point in time there will then be infed an adequate supply of printed products 6, so that each gripper 3 can entrain a product copy. After completion of the start-up phase, there are then conveyed such a number of printed products 6 to the transfer region 27 that each gripper 3 must engage two or more printed products. If in such case a printed product 6 arrives too late in time in order to still be able to travel into a gripper 3, then such printed product 6 will be engaged by the next following gripper 3.

Figure 4:
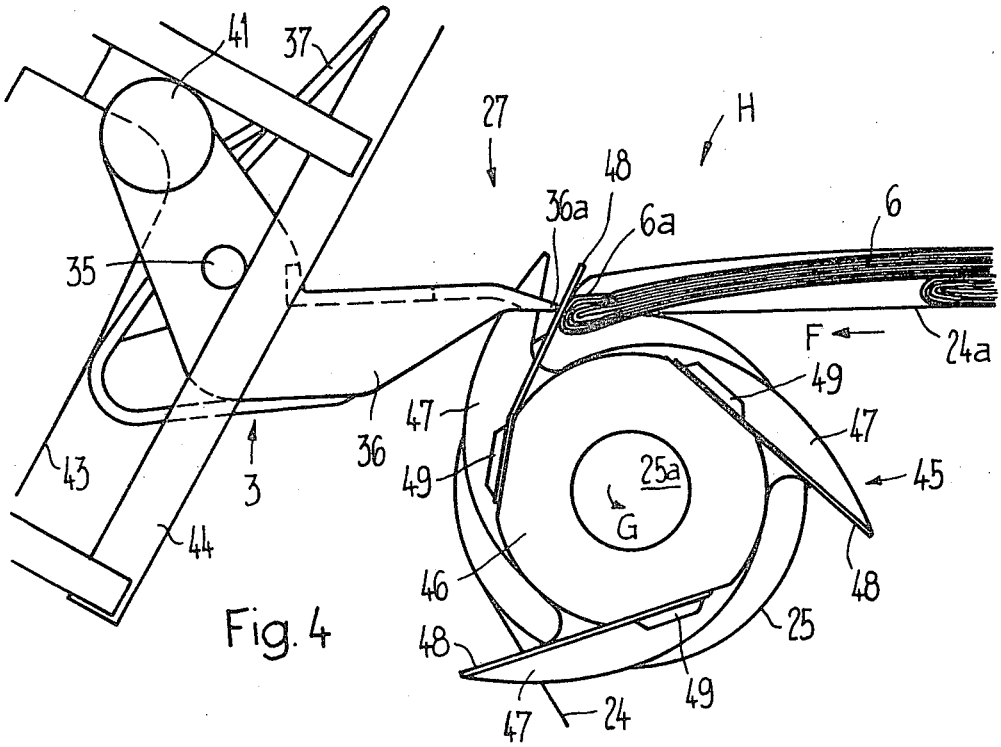
FIGS. 4 and 5 respectively show in side view the transfer region with a deflection device for the arriving printed products and illustrating different operating positions.
Figure 5:
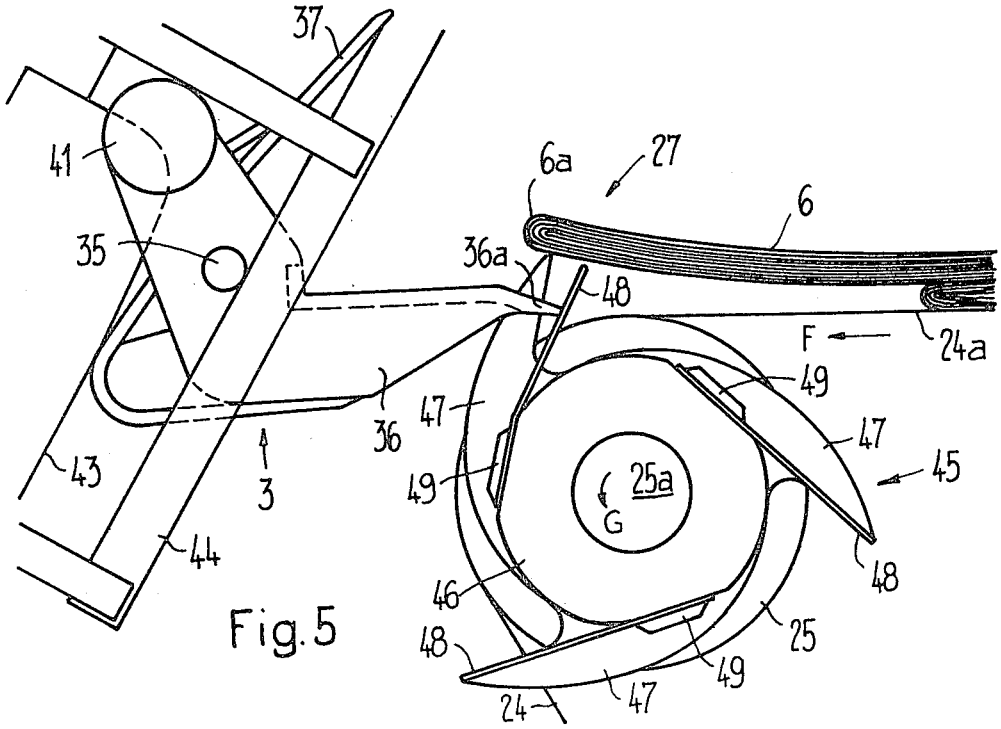

It is of importance that with non-exact phase position of the grippers 3 and the printed products 6 which are to be engaged, to avoid that the leading 6*a* of a printed product 6 will impact against the lower clamping jaw 36, and thus, become damaged. Therefore, as described, for this purpose the lower clamping jaw 36 is provided at its forwardmost edge 36*a* with a guide or directing surface 42. Such measure does not, however, as a general rule, afford adequate safeguards against damage to the printed products 6. Now as shown in FIGS. 4 to 6 there is therefore provided at the transfer region 27 a deflection device, generally indicated by reference character 45. This deflection device 45 comprises a wheel 46 which is rotatably mounted for rotation in the direction of the arrow G, upon the shaft 25*a* of the deflection roll 25 of the conveyor belt or band 24. This wheel 46 is equipped with three fingers or protuberances 47 or equivalent structure which protrude from its outer surface or circumference. To both sides of each finger 47 there are arranged leaf springs 48 or equivalent structure, which are fixed at their one end by means of threaded bolts or screws 49 at the wheel 46. As best seen by referring to FIG. 6, the lower clamping jaws 36 of the grippers 3 possess at their forward edge 36*a* a recess 50 through which piercingly extend the fingers 47.

Now there will be considered the mode of operation of such deflection device 45 which is as follows:

Upon rotation of the wheel 46 the fingers 47 are periodically moved from below into the imbricated product stream. Thus, the fingers 47 come into contact with the printed product 6 which is momentarily to be engaged, thereby causing, as shown in FIG. 5, a slight raising of the front edge 6*a* of the printed product 6. Due to this raising of the front edge 6*a* of the engaged printed product, there is insured for a positive engagement of such printed product 6 from below by the lower clamping jaw 36, and thus, a faultless entrainment of the printed product 6 by the gripper 3. If, however, a printed product 6 arrives with a certain delay, so that, as shown in FIG. 4, it no longer can be lifted by the passing finger 47 and directed into the arriving gripper 3, then the leaf or blade springs 48 insure that there is avoided impacting of the front edge 6*a* of the printed product 6 upon the front edge 36*a* of the lower clamping jaw 36. The leaf springs 48 or equivalent structure are deflected by the passing lower clamping jaw 36, so that they serve as stop or impact means for a late arriving printed product 6. As apparent from the showing of FIG. 4, the printed product 6 which travels onto the deflected leaf springs 48, is somewhat downwardly deflected at its leading edge 6*a*, so that damage to such printed product 6 cannot arise. This printed product 6, which is held back to the leaf or blade springs 48 or the like, is now, during the further rotation of the wheel 46, upwardly deflected by the next following finger 47 and infed to the next gripper 3. Hence, this deflection device 45 insures that the phase-correct arriving printed products 6 can faultlessly travel into the arriving, opened gripper 3, and that tardy arriving printed products, which no longer can be faultlessly entrained by the passing gripper 3, can travel, without damage, into the next gripper.

As explained, the conveying direction A of the individual conveyor 1, at the transfer region 27, extends from below upwardly and at an angle of about 60° with respect to the horizontal. However, it is also possible to select such angle to be smaller, for instance to amount to 30°, or greater, for instance to amount to 90°, so that the conveying direction A, at the transfer region 27, extends in essentially vertical direction, or encloses with the vertical an acute angle. It is equally possible to select the conveying direction F of the portion or section 24*a* of the conveyor belt 24 such that, instead of it extending in horizontal direction, it forms with the horizontal an acute angle, i.e., either extends at an inclination upwardly or at an inclination downwardly. In such case the imbricated product stream S is deflected through an angle which is greater or less than 180°.

It should be understood that there can be arranged following the conveyor belt or band 24 a further conveyor or conveyor means which receives the printed products from the conveyor belt and infeeds the same to the grippers 3. These grippers 3, and thus, the entire individual conveyor 1, also can be differently constructed than has been illustrated and described.

A deflection or turning of the arriving imbricated product stream can be accomplished in a different manner than by means of the described deflection device 12, for instance, by turning the imbricated product stream about its lengthwise axis through 180°, as such has been disclosed for instance in Swiss Pat. No. 530,926 and the corresponding U.S. Pat. No. 3,735,977, to which reference may be readily had.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for outfeeding essentially flat products, especially printed products, arriving in an imbricated product stream, comprising:

a conveyor device having a predetermined direction of conveying of the products;

individually controllable grippers arranged in tandem at said conveyor device in the direction of conveying of the products and at a predetermined distance from one another;

said individually controllable grippers serving for engaging the infed products at their leading edge;

means for infeeding the products to said conveyor device in an imbricated product formation where each product bears upon the next following product; and said predetermined direction of conveying, at least at a transfer region of the products from said infeeding means to said conveyor device, being directed from the underside of the product to be engaged by the gripper towards the upper side of said product and extending essentially transversely with respect to a plane defined by the product to be engaged in order to lift the topmost product from the imbricated product formation in a manner so as not to essentially disrupt the remainder of the imbricated product formation.

2. The apparatus as defined in claim 1, wherein:

said infeeding means comprises an infeed device;

said infeeding means including a turning device arranged upstream, with respect to the direction of movement of the products, of the conveyor device;

said turning device causing a turning of the arriving imbricated product stream formed by each product of the imbricated product stream bearing upon its immediately leading product.

3. The apparatus as defined in claim 2, wherein: said turning device serves to turn the arriving imbricated product stream through an angle of about 180° about its longitudinal axis which extends essentially parallel to the direction of conveying of the products.

4. The apparatus as defined in claim 2, wherein:

said turning device comprises a deflection device through which passes the imbricated product stream;

said deflection device serving for the deflection of the imbricated product stream;

said deflection device having an outfeed end having a direction of product conveying which is opposite to the direction of conveying of the imbricated product stream arriving at the deflection device.

5. The apparatus as defined in claim 4, wherein:

said deflection device includes structure defining a conveying gap where there occurs a pressing of the throughpassing imbricated product stream.

6. The apparatus as defined in claim 5, wherein:

said structure defining said conveying gap comprises a rotatable deflection drum and an endless revolving pressing band forming together with said deflection drum said conveying gap.

7. The apparatus as defined in claim 6, further including:

an endless revolving conveyor belt guided over said deflection drum;

said endless revolving conveyor belt conveying the imbricated product stream, departing out of said conveying gap, towards the conveyor device.

8. The apparatus as defined in claim 6, wherein:

said pressing band constitutes a driven band means; and at least one tension roll over which there is guided said driven band means.

9. The apparatus as defined in claim 8, further including:

an endless revolving conveyor belt guided over said deflection drum;

said endless revolving conveyor belt conveying the imbricated product stream, departing out of said conveying gap, towards the conveyor device.

10. The appartus as defined in claim 5, wherein:

said means for infeeding includes belt conveyor means arranged forwardly of said deflection device; and said belt conveyor means serving for the infeed of the arriving imbricated product stream to the conveying gap.

11. The apparatus as defined in claim 10, wherein:

said belt conveyor means possesses an essentially horizontal direction of conveying;

said deflection device including a conveyor belt;

said conveyor belt having a portion merging at its outfeed side at said conveying gap and which is effective opposite to the belt conveyor means.

12. The apparatus as defined in claim 11, wherein:

said portion of said conveyor belt extends essentially horizontally.

13. The apparatus as defined in claim 11, wherein:

said portion of said conveyor belt is inclined with respect to the horizontal.

14. The apparatus as defined in claim 10, further including:

alignment means arranged laterally of the belt conveyor means; and said alignment means serving for the alignment of the products within the imbricated product stream.

15. The apparatus as defined in claim 14, wherein:

said belt conveyor means possesses an essentially horizontal direction of conveying;

said deflection device including a conveyor belt;

said conveyor belt having a portion merging at its outfeed side at said conveying gap and which is effective opposite to the belt conveyor means.

16. The apparatus as defined in claim 15, wherein:

said portion of said conveyor belt extends essentially horizontally.

17. The apparatus as defined in claim 15, wherein:

said portion of said conveyor belt extends at an inclination with respect to the horizontal.

18. The apparatus as defined in claim 1, wherein:

the direction of conveying of the conveyor device, at the transfer region of the products, forming together with the direction of conveying of the imbricated product stream incoming at the transfer region, a predetermined angle.

19. The apparatus as defined in claim 18, wherein:

the direction of conveying of the conveyor device extends at least at the transfer region essentially in vertical direction.

20. The apparatus as defined in claim 18, wherein:

the direction of conveying of the conveyor device, at least at the transfer region, extends at an acute angle with respect to the vertical.

21. The apparatus as defined in claim 18, wherein:

the direction of conveying of the conveyor device, at least at the transfer region, extends at a predetermined angle.

22. The apparatus as defined in claim 18, further including:

impact means for the leading edge of the product to be engaged by a gripper arranged at the transfer region.

23. The apparatus as defined in claim 18, wherein:

said conveyor device comprises an individual conveyor;

the speed of conveying of the individual conveyor and the number of products conveyed per unit of time to the transfer region being matched to one another such that each gripper engages at least two products.

24. The apparatus as defined in claim 18, further including:

a contactless operating counter device arranged at the transfer region and controlled by the leading edge of the product to be engaged by a related one of the grippers.

25. The apparatus as defined in claim 1, wherein:

each gripper comprises two substantially clamplike, coacting clamping jaws movable between a clamping position, against the action of spring force, and an open position; and shaft means about which there are conjointly pivotable said coacting clamping jaws.

26. The apparatus as defined in claim 25, wherein:

one of said clamping jaws comprises two movable elements which can be moved independently of one another with respect to the other clamping jaw.

27. The apparatus as defined in claim 25, further including:

cam means for rocking and opening the grippers moving towards a transfer region located between said infeeding means and said conveyor device.

28. The apparatus as defined in claim 27, wherein:

one of said clamping jaws is intended to engage beneath the printed products;

said one clamping jaw having at a front edge thereof a guide surface for directing the incoming product into the opened gripper.

29. The apparatus as defined in claim 28, wherein:

said front edge possesses a substantially wedgeshaped configuration.

30. An apparatus for outfeeding essentially flat products, especially printed products, arriving in an imbricated product stream, comprising:

a conveyor device having a predetermined direction of conveying of the products;

individually controllable grippers arranged in tandem at said conveyor device;

said individually controllable grippers serving for engaging the infed products at their leading edge;

means for infeeding the products to said conveyor device in an imbricated formation where each product bears upon the next following product;

a deflection mechanism provided at a transfer region for the products between said infeeding means and said conveyor device;

said deflection mechanism being periodically introduceable into the arriving imbricated product stream;

said deflection mechanism acting upon a leading edge of the product to be engaged and deflecting such product, depending upon the mutual position of the product to be engaged and the passing gripper, either to such passing gripper or the next following gripper.

31. The apparatus as defined in claim 30, wherein:

said deflection mechanism comprises a revolvingly driven wheel arranged beneath the imbricated product stream;

said revolvingly driven wheel having fingers protruding from its circumference;

said protruding fingers upwardly deflecting the product to be engaged upon passage of the leading edge of such product.

32. The apparatus as defined in claim 31, further including:

at least one deflecting element operatively associated with each finger and controlled by the passing gripper;

a product which has not been deflected by the related finger impacting against said deflection element in order to be infed to the next following gripper.

* * * * *